US005904787A

United States Patent [19]

Matsumoto et al.

[11] Patent Number: 5,904,787

[45] Date of Patent: May 18, 1999

[54] OIL-TEMPERED WIRE AND METHOD OF MANUFACTURING THE SAME

[75] Inventors: Sadamu Matsumoto; Teruyuki Murai; Takashi Yoshioka, all of Itami, Japan

[73] Assignee: Sumitomo Electric Industries, Ltd., Osaka, Japan

[21] Appl. No.: 08/668,160

[22] Filed: Jun. 21, 1996

[30] Foreign Application Priority Data

Sep. 1, 1995 [JP] Japan ..... 7-248412

[51] Int. Cl.[6] ..... B21F 21/00; C21D 9/02; C22C 38/00

[52] U.S. Cl. ..... 148/333; 420/105; 428/544; 148/663

[58] Field of Search ..... 428/544, 677; 148/529, 516, 595, 333, 320, 663; 420/100, 104, 105, 109, 111, 117, 118, 123, 124, 127

[56] References Cited

U.S. PATENT DOCUMENTS

| | | | |
|---|---|---|---|
| 4,123,296 | 10/1978 | Yamakoshi et al. | 148/36 |
| 4,525,598 | 6/1985 | Tsukamoto et al. | 174/128 R |
| 4,770,721 | 9/1988 | Yamamoto | 148/144 |
| 4,795,609 | 1/1989 | Saka et al. | 420/109 |
| 4,810,287 | 3/1989 | Saka et al. | 75/49 |
| 4,823,451 | 4/1989 | Terrasse et al. | 29/129.5 |
| 4,889,567 | 12/1989 | Fujiware et al. | 148/12 B |
| 5,066,455 | 11/1991 | Kim et al. | 420/100 |
| 5,167,727 | 12/1992 | Kim et al. | 524/407 |
| 5,229,069 | 7/1993 | Shemenski et al. | 420/104 |
| 5,240,520 | 8/1993 | Tarui et al. | 148/532 |
| 5,575,973 | 11/1996 | Choi | 420/112 |

FOREIGN PATENT DOCUMENTS

| | | |
|---|---|---|
| 59096246 | 6/1984 | Japan . |
| 3162550 | 7/1991 | Japan . |

OTHER PUBLICATIONS

Patent Abstracts of Japan, Publication No. 59096246 A, Steel Wire for Cold Formed Spring of Extra High Strength Its Production and Cold Formed Spring of Extra High Strength Obtained from Said Steel Wire, Publication Date Jun. 2, 1984.

Patent Abstracts of Japan, Publication No. 03162550 A, High Strength and High Ductility Oil Tempered Steel Wire and Its Manufacture, Publication Date Jul. 12, 1991.

*Primary Examiner*—John J. Zimmerman
*Assistant Examiner*—Michael LaVilla
*Attorney, Agent, or Firm*—Wenderoth, Lind & Ponack, L.L.P.

[57] ABSTRACT

A high-toughness, quenched, oil-tempered wire for springs which is less likely to suffer a permanent set and is high in strength and toughness. The wire is made of a steel containing predetermined amounts of C, Si, Mn, Al and Ti, to which are selectively added predetermined amounts of V, Mo, W and Nb. After quenching and tempering, the content of retained austenite is 1–5 vol. %, and/or the number of carbides having a diameter of 0.05 $\mu$m or more is 5 or less per $\mu m^2$ as viewed on a transmission electron microscope image.

10 Claims, No Drawings

OIL-TEMPERED WIRE AND METHOD OF MANUFACTURING THE SAME

BACKGROUND OF THE INVENTION

The present invention relates to an oil-tempered wire, and more specifically an oil-tempered wire having sufficient toughness as a material for high-strength springs used as valve springs for automotive engines.

Valve springs for automotive engines are used in extremely harsh conditions in which they are subjected to high stress and high revolving speed. In particular, valve springs used in recent car engines, which are small in size and consume less fuel, are used in still severer environments. It is therefore desirable to increase the strength of material for such valve springs still further. Valve springs are formed from an oil-tempered wire of chrome-vanadium steel for valve springs or an oil-tempered wire of silicon-chrome steel for valve springs. Efforts are being made to increase the strength of these wire materials.

But a wire having increased strength tends to be low in toughness and ductility, so that it is liable to be broken while being formed into springs.

In order to solve this problem, Examined Japanese Publication 3-6981 proposes to control the content of vanadium and the quenching conditions so that the crystal grain size will be 10 or more, thereby keeping high toughness of the wire. For the same purpose, Unexamined Japanese Patent Publication 3-162550 proposes an oil-tempered wire having a tempered martensite, that is, a matrix after tempering, in which is present a residual austenite phase in an amount of 5–20%.

But in the former, it is impossible to markedly increase the strength and toughness if the crystal grain size is 10 or more. In the latter, if the residual austenite phase is present in a large amount, it may transform into a martensite phase while the wire is used as springs. If this happens, it may suffer a permanent set due to increased volume. That is, such a wire is less resistant to permanent setting.

An object of the present invention is to provide an oil-tempered wire for springs which is less likely to suffer a permanent set and is high in strength and toughness.

As a result of our efforts, we have discovered that it is possible to increase toughness while keeping high resistance to permanent setting by finely dispersing a residual austenite phase in a tempered martensite at a volume rate of 1% to 5% and by controlling the number of carbides having diameters of 0.05 $\mu$m or more to 5 or less per $\mu m^2$ as observed on a transmission electron microscope (TEM) image.

SUMMARY OF THE INVENTION

According to this invention, there is provided a high-toughness, quenched, oil-tempered wire for springs made of a steel containing in weight percent 0.5–0.8% C, 1.2–2.5% Si, 0.4–0.8% Mn, 0.7–1.0% Cr, 0.005% or less Al and 0.005% or less Ti, the steel containing, after quenching and tempering, 1% to 5% by volume of retained austenite.

The steel may further contain 0.05–0.15% by weight of vanadium, or further at least one of 0.05–0.5% by weight of Mo, 0.05–0.15% by weight of W and 0.05–0.15% by weight of Nb.

In another arrangement, the number of carbides having diameters 0.05 $\mu$m or more is 5 or less per $\mu m^2$ as observed on a TEM image, instead of restricting the content of retained austenite.

In still another arrangement, both the number of carbides and the content of retained austenite are restricted.

The present invention also provides a method of manufacturing oil-tempered wires as described above under specific quenching and tempering conditions.

Now we will explain why the steel composition has been restricted.

1) C: 0.5–0.8 wt. %

C is essential to increase the strength of the steel wire. If its content is less than 0.5%, the strength of the wire will be insufficient. On the other hand, a steel wire containing more than 0.8% carbon is low in toughness. Such a wire is not reliable enough because it is more liable to get marred.

2) Si: 1.2–2.5 wt. %

Si helps increase the strength of ferrite and thus improve the resistance to permanent set. If its content is less than 1.2%, this effect cannot be achieved sufficiently. If over 2.5%, hot and cold machinability will drop. Also, such a large amount will promote decarbonization during heat treatment.

3) Mn: 0.4–0.8 wt. %

Mn improves the hardening properties of the steel and prevents any harmful effect caused by sulfur in the steel by fixing it. If its content is less than 0.4%, this effect cannot be achieved sufficiently. If over 0.8%, the toughness will drop.

4) Cr: 0.7–1.0 wt. %

Like Mn, Cr improves the hardening properties of the steel. It also serves to increase the toughness of the wire by patenting after hot rolling and to increase the resistance to softening during tempering after quenching and thus the strength of the wire. If its content is less than 0.7%, this effect cannot be achieved sufficiently. If over 1.0%, Cr will hinder carbides from turning into solid solution, thus lowering the strength of the wire. Also, such a large amount will cause excessive tempering action, leading to reduced toughness.

5) V: 0.05–0.15 wt. %

Vanadium helps the formation of carbides during tempering, thus increasing the resistance to softening of the wire. If its content is less than 0.05%, this effect will be insufficient. If over 0.15%, a large amount of carbides will be formed during heating for quenching, which will lower the toughness of the wire.

6) Mo: 0.05–0.5 wt. %

Mo helps the formation of carbides during tempering, thus increasing the resistance to softening of the wire. If its content is less than 0.05%, this effect will be insufficient. If over 0.5%, wire drawing will become difficult.

7) W: 0.05–0.15 wt. %

Tungsten helps the formation of carbides during tempering, thus increasing the resistance to softening of the wire. If its content is less than 0.05%, this effect will be insufficient. If over 0.15%, too large an amount of carbides will be formed during heating for quenching so that the toughness of the wire will drop.

8) Nb: 0.05–0.15 wt. %

Nb helps the formation of carbides during tempering, thus increasing the resistance to softening of the wire. If its content is less than 0.05%, this effect will be insufficient. If over 0.15%, too large an amount of carbides will be formed during heating for quenching, so that the toughness of the wire will drop.

9) Al, Ti: 0.005 wt. % or less

They form $Al_2O_3$ and TiO which are high-melting point, non-metallic inclusions. These inclusions are hard and can markedly lower the fatigue strength if present near the steel wire surface. Thus, though they are unavoidable impurities, their contents have to be 0.005 wt. % or less. For this purpose, a raw material containing lesser impurities should be selected.

10) Reason why the content of retained austenite is restricted to 1–5% by volume A retained austenite phase present in the tempered martensite improves the toughness of the steel wire. If its content is less than 1%, the effect will be insufficient. But if its content is more than 5%, the resistance to permanent set will decrease due to martensitic transformation while the wire is used as a spring.

11) Reason why the number of carbides (0.05 $\mu$m or more in particle diameter) is restricted to 5 or less per $\mu m^2$ as observed on a TEM imgae.

Carbides having diameters of 0.05 $\mu$m or more can be starting points of destruction while forming springs. Thus, if the number of such carbides exceeds 5 per $\mu m^2$ as observed on a TEM image, the toughness of the wire will drop markedly.

The content of retained austenite and the density of carbides can be adjusted to the abovementioned values by subjecting the wire to the following heat treatment.

The heating time for quenching in the quenching/tempering step before the cooling step is started, should be within 15 seconds. Otherwise, crystal grains will grow too large, lowering the toughness of the wire. If the heating rate is 150° C./sec or lower, it is impossible to resolve carbides sufficiently within the 15-second interval before the cooling step begins. If the heating temperature is 1100° C. or higher, crystal grains will grow too large, thus lowering the toughness or causing decarbonization. If T (°C.) is equal to 500+750° C.+500.V or less (wherein C is the content of carbon in weight % and V is the content of vanadium in weight %), carbides will not be resolved sufficiently.

Tempering during the quenching/tempering step has to be finished within 15 seconds before the cooling step is started, while keeping the heating rate at 150° C./sec or higher. Otherwise, the retained austenite phase will decrease to less than 1% by volume.

DETAILED DESCRIPTION OF THE EXAMPLES 4.0-mm-diameter wires were formed by melting, rolling, heat-treating and drawing specimens having the chemical compositions shown in Table 1. After quenching and tempering these wires under predetermined conditions, the amount of retained austenite phase was measured using X-rays, and the amount of carbides was measured by observing the wire structure. Also, they were subjected to a tensile test to measure the toughness in terms of reduction of area.

EXAMPLE 1

After quenching and tempering Specimens A-I under the conditions shown in Table 2, measurement of retained austenite and a tensile test were carried out. The results for Specimens A, B, C and I are shown in Table 3.

The amounts of retained austenite in the specimens manufactured by the method of the present invention were 1–5 vol. %. It is thus apparent that their toughness is sufficiently high.

EXAMPLE 2

After quenching and tempering Specimens A-I under the conditions shown in Table 4, the amount of carbides (0.05 $\mu$m or more) in each specimen was measured, and then the specimens were subjected to a tensile test. The results for Specimens A, B, D and H are shown in Table 5.

From Table 5, it is apparent that the specimens according to Example 2, having 5 or less carbides per square micrometer, are sufficiently tough.

As described above, the oil-tempered wire for springs according to the present invention is highly resistant to permanent set and highly strong and tough.

TABLE 1

| Specimen | C | Si | Mn | Cr | Al | Ti | V | Mo | W | Nb |
|---|---|---|---|---|---|---|---|---|---|---|
| A | 0.56 | 1.38 | 0.68 | 0.77 | 0.002 | 0.002 | — | — | — | — |
| B | 0.64 | 1.98 | 0.67 | 0.68 | 0.002 | 0.002 | 0.13 | — | — | — |
| C | 0.64 | 1.41 | 0.67 | 0.73 | 0.002 | 0.002 | 0.12 | 0.20 | — | — |
| D | 0.65 | 1.38 | 0.68 | 0.72 | 0.002 | 0.002 | 0.12 | — | 0.10 | — |
| E | 0.65 | 1.40 | 0.68 | 0.73 | 0.002 | 0.002 | 0.12 | — | — | 0.09 |
| F | 0.74 | 1.41 | 0.68 | 0.74 | 0.002 | 0.002 | 0.12 | 0.20 | 0.09 | — |
| G | 0.64 | 1.41 | 0.68 | 0.73 | 0.002 | 0.002 | 0.11 | 0.21 | — | 0.09 |
| H | 0.65 | 1.39 | 0.69 | 0.73 | 0.002 | 0.002 | 0.12 | — | 0.10 | 0.10 |
| I | 0.63 | 1.40 | 0.68 | 0.72 | 0.002 | 0.002 | 0.11 | 0.20 | 0.10 | 0.09 |

TABLE 2

| | Quenching/tempering conditions | | | | | |
|---|---|---|---|---|---|---|
| | Quenching conditions | | | Tempering condition | | |
| Condition | Heating rate (° C./sec) | Heating temperature (° C.) | Heating time* (sec) | Heating rate (° C./sec) | Heating temperature (° C.) | Heating time* (sec) |
| I | 250 | 1050 | 8 | 250 | 500 | 4 |
| II | 250 | 1050 | 8 | 250 | 460 | 8 |
| III | 250 | 1050 | 8 | 50 | 600 | 20 |
| IV | 250 | 1050 | 8 | 50 | 520 | 40 |
| V | 250 | 1050 | 8 | 50 | 470 | 60 |
| VI | 250 | 1050 | 20 | 250 | 400 | 20 |

I· II: Examples

III IV · V · VI: Comparative examples

*Heating time is the time from start of heating to start of cooling.

TABLE 3

Retained austenite content and reduction of area

| | Examples | | | | Comparative examples | | | | | | | |
|---|---|---|---|---|---|---|---|---|---|---|---|---|
| | I | | II | | III | | IV | | V | | VI | |
| A | 3 | 51 | 2 | 49 | 0 | 42 | 0 | 42 | 0 | 41 | 0 | 43 |
| B | 5 | 44 | 3 | 44 | <1 | 37 | 0 | 34 | <1 | 36 | 0 | 34 |
| C | 5 | 43 | 2 | 44 | <1 | 37 | 0 | 36 | 0 | 37 | <1 | 35 |
| I | 4 | 41 | 2 | 40 | 0 | 34 | 0 | 32 | 0 | 32 | 0 | 33 |
| | Retained austenite content (vol %) | | | | | | Reduction of area (%) | | | | | |

TABLE 4

Quenching/tempering conditions

| | Quenching conditions | | | Tempering conditions | | |
|---|---|---|---|---|---|---|
| Condition | Heating rate (° C./sec) | Heating temperature (° C.) | Heating time* (sec) | Heating rate (° C./sec) | Heating temperature (° C.) | Heating time* (sec) |
| I | 250 | 1050 | 8 | 250 | 500 | 4 |
| II | 250 | 850 | 8 | 250 | 500 | 4 |
| III | 50 | 1050 | 60 | 250 | 500 | 4 |
| IV | 250 | 1050 | 20 | 250 | 500 | 4 |
| V | 250 | 1150 | 8 | 250 | 500 | 4 |
| VI | 250 | 1050 | 20 | 250 | 400 | 20 |

I: Example
II · III · IV · V · VI: Comparative examples
*Heating time is the time from start of heating to start of cooling.

TABLE 5

Density of carbides and reduction of area

| | Examples | | | | Comparative examples | | | | | | | |
|---|---|---|---|---|---|---|---|---|---|---|---|---|
| | I | | II | | III | | IV | | V | | VI | |
| A | <1 | 51 | 6 | 43 | 7 | 40 | 6 | 40 | 6 | 41 | 6 | 42 |
| B | <1 | 44 | 7 | 37 | 7 | 35 | 7 | 37 | 6 | 36 | 8 | 35 |
| D | <1 | 43 | 7 | 36 | 8 | 34 | 6 | 37 | 7 | 37 | 7 | 36 |
| H | 3 | 44 | 9 | 35 | 8 | 35 | 6 | 33 | 7 | 37 | 8 | 34 |
| | Carbide density (number/$\mu m^2$) | | | | | | Reduction of area (%) | | | | | |

What is claimed is:

1. A high-toughness, quenched, oil-tempered wire for springs comprising a steel containing in weight percent 0.5–0.8% C, 1.2–2.5% Si, 0.4–0.8% Mn, 0.7–1.0% Cr, 0.005% or less Al and 0.005% or less Ti, wherein the steel consists essentially of martensite and austenite and the number of carbide particles having a diameter of 0.05 $\mu$m or more is 5 or less per $\mu m^2$ as viewed on a transmission electron microscope image after quenching and tempering.

2. A high-toughness, quenched, oil-tempered wire as claimed in claim 1, wherein said steel further contains 0.05–0.15% by weight of V.

3. A high-toughness, quenched, oil-tempered wire as claimed in claim 1 or 2 wherein said steel further contains at least one of 0.05–0.5% by weight of Mo, 0.05–0.15% by weight of W and 0.05–0.15% by weight of Nb.

4. A high-toughness, quenched, oil-tempered wire for springs comprising a steel containing in weight percent 0.5–0.8% C, 1.2–2.5% Si, 0.4–0.8% Mn, 0.7–1.0% Cr, 0.005% or less Al and 0.005% or less Ti, wherein after quenching and tempering, said steel contains 1% to 5% by volume of retained austenite dispersed in martensite and the number of carbide particles having a diameter of 0.05 $\mu$m or more is 5 or less per $\mu m^2$ as viewed on a transmission electron microscope image.

5. A high-toughness, quenched, oil-tempered wire as claimed in claim 4, wherein said steel further contains 0.05–0.15% by weight of V.

6. A high-toughness, quenched, oil-tempered wire as claimed in claim 4 or 5 wherein said steel further contains at least one of 0.05–0.5% by weight of Mo, 0.05–0.15% by weight of W and 0.05–0.15% by weight of Nb.

7. A method of manufacturing the high-toughness, quenched, oil-tempered wire as claimed in claim 1 or 2 wherein quenching during a quenching/tempering step is carried out by heating to a temperature not higher than 1100° C. and not less than a temperature determined by T (°C.)= 500+750.C+500.V at a heating rate of 150°C./sec. or more for 15 seconds or less from the start of heating to the start of cooling with water or oil, wherein C is the content of carbon in weight % and V is the content of vanadium in weight %.

8. A method of manufacturing the high-toughness, quenched, oil-tempered wire as claimed in claim 4 or 5 wherein quenching during a quenching/tempering step is carried out by heating to a temperature not higher than 1100° C. and not less than a temperature determined by T (°C.)= 500+750.C+500.V at a heating rate of 150°C./sec. or more for 15 seconds or less from the start of heating to the start of cooling with water or oil, wherein C is the content of carbon in weight % and V is the content of vanadium in weight %, and wherein tempering in the quenching/tempering step is carried out at a heating rate of 150° C./sec or more to a temperature of 450° C. to 600° C. for 15 seconds or less from the start of heating to the start of cooling with water or oil.

9. A method of manufacturing the high-toughness, quenched, oil-tempered wire as claimed in claim 3 wherein quenching during a quenching/tempering step is carried out by heating to a temperature not higher than 1100° C. and not less than a temperature determined by T (°C.)=500+750.C+ 500.V at a heating rate of 150° C./sec. or more for 15 seconds or less from the start of heating to the start of cooling with water or oil, wherein C is the content of carbon in weight % and V is the content of vanadium in weight %.

10. A method of manufacturing the high-toughness, quenched, oil-tempered wire as claimed in claim 6 wherein quenching during a quenching/tempering step is carried out by heating to a temperature not higher than 1100° C. and not less than a temperature determined by T (°C.)=500+750.C+ 500.V at a heating rate of 150° C./sec. or more for 15 seconds or less from the start of heating to the start of cooling with water or oil, wherein C is the content of carbon in weight % and V is the content of vanadium in weight %, and wherein tempering in the quenching/tempering step is carried out at a heating rate of 150° C./sec or more to a temperature of 450° C. to 600° C. for 15 seconds or less from the start of heating to the start of cooling with water or oil.

* * * * *